US006385954B2

(12) United States Patent
Huffman

(10) Patent No.: US 6,385,954 B2
(45) Date of Patent: May 14, 2002

(54) PROCESSING OF AMERICAN BUFFALO HAIR TO PRODUCE A YARN

(76) Inventor: Ruth Huffman, 915 S. Bishop Ave., Dallas, TX (US) 75208

( * ) Notice: Subject to any disclaimer, the term of this patent is extended or adjusted under 35 U.S.C. 154(b) by 0 days.

(21) Appl. No.: 09/824,457

(22) Filed: Apr. 2, 2001

Related U.S. Application Data

(63) Continuation-in-part of application No. 09/549,271, filed on Apr. 14, 2000, now Pat. No. 6,237,315.
(60) Provisional application No. 60/129,422, filed on Apr. 15, 1999.

(51) Int. Cl.[7] ..... D02G 1/00
(52) U.S. Cl. ..... 57/28; 57/1 R; 57/327; 19/150
(58) Field of Search ..... 57/1 R, 4, 28, 57/327; 8/128.1, 128.3; 19/98, 150, 157

(56) References Cited

U.S. PATENT DOCUMENTS 3,840,401 A * 10/1974 Umezawa et al. ..... 8/128
3,979,893 A * 9/1976 Gelli et al. ..... 19/150
4,343,619 A * 8/1982 Kazama et al. ..... 8/139
5,478,358 A * 12/1995 Kato ..... 8/115.52
5,980,579 A * 11/1999 Yoon ..... 8/128.1

* cited by examiner

*Primary Examiner*—John J. Calvert
*Assistant Examiner*—Gary L. Welch
(74) *Attorney, Agent, or Firm*—Gardere Wynne Sewell LLP; Sanford E. Warren, Jr.; Edwin S. Flores

(57) ABSTRACT

A method for making a pure buffalo yarn is disclosed and includes the steps of, scouring a buffalo fleece with detergent and water at a temperature of at least 80 degrees centigrade to clean the fleece, dehairing the buffalo fleece to remove unwanted course hair from the fleece to produce dehaired fine soft fibers, blending the dehaired fine soft fibers with an oil and water emulsion in a mixing picker to produce a mixed fiber, carding the mixed fiber at 50 weight percent of normal to produce a roving of straight and parallel fibers, spinning the roving to produce a yarn and twisting the yarn to increase the bulk and softness of the yarn.

19 Claims, 2 Drawing Sheets

PROCESSING OF AMERICAN BUFFALO HAIR TO PRODUCE A YARN

This Application is a CIP of Ser. No. 09/549,271 filed Apr. 14, 2000 now U.S. Pat. No. 6,237,315 and claims Benefit of Provisional of Application Ser. No. 60/129,422 filed Apr. 15, 1999.

TECHNICAL FIELD OF THE INVENTION

The present invention relates in general to the field of processing of buffalo hair, and more particularly, to the creation and production of a yarn useful for the creation of garments made of buffalo hair and buffalo down.

BACKGROUND OF THE INVENTION

Without limiting the scope of the invention, its background is described in connection with the formation of fibers and yarn, as an example.

Heretofore, in this field, animal fibers have been used for the creation, formation and manipulation of yarns that are useful for the manufacture of clothing. In order to produce sufficient yarn of sufficient strength a number of yarn types have been created that take advantage of different weaves and weave patterns to produce yarns. More recently, the introduction of synthetic fibers for the production of yarn yields increases in production and the strength of fibers.

For production of wool yarn, for example, the wool fibers must be spun on worsted system or on woolen system. On a worsted system, the wool staple length is long and distribution of the length usually is extremely uneven compared to those of cotton. Wool top is virtually impossible to draft with roller drafting, mechanism. Good uniformity of product requires faller bar incorporation into the process.

If a distance between drafting rollers could be set in accordance with the longest fiber length, shorter fibers would be floated, when being drafted, while longer fibers that exceed the distance between the rollers, would be broken or cut. In the former case, fallers must be applied on gill frame to control these floating fibers.

Cotton-wool blended yarns have been spun with squared wool fiber, but all-wool yarns like worsted yarns cannot be spun by means of the conventional cotton system until now. With worsted yarns produced by the conventional worsted yarn system, long fibers of more than 120 mm length of wool top occupies only about 10% of the total. Therefore, for the purpose of uniform drafting, gilling should be used. In general, however, worsted spinning system is considered as of higher cost and lower in productivity, which results in much higher spinning costs in worsted system than in cotton system. Likewise, the creation of a yarn based on buffalo has always required that, at a minimum, a significant amount of wool be interspersed with the buffalo hair and/or fibers. At least one problem with the buffalo-wool blend is that it is more characteristic in feel, comfort and durability to wool than to buffalo.

To date, no one has been able to produce a yarn based solely on buffalo or bison hair (termed collectively herein "buffalo") at a lower cost, as well as higher productivity and good quality. Whole buffalo hair and buffalo down blended with a minimum of 40% wool fibers have long been used for providing durable, warm and comfortable protection in cold and warm weathers. A yarn based solely on buffalo hair and fibers would be expected to have similar or improved characteristics, however, the inability to produce such yarn in an efficient, cost-effective manner has not been achieved.

SUMMARY OF THE INVENTION

It has been found, however, that the present invention may be used to produce yarn from buffalo hair and fibers in an efficient and cost-effective manner. In the industry it has long been felt that buffalo hair could not be formed into yarn due to characteristics of the fibers that were incompatible with the yarn manufacturing systems, viz., the woolen, worsted and cotton systems.

A significant problem of the woolen, worsted and cotton systems is that they were not designed for the formation of yarn from complex fleece, such as buffalo fleece. One problem with buffalo fleece is that it may contain up to 5 different types of hair fibers, that is, it is a multi-layered fleece.

What is needed is a method of preparing buffalo hair and fibers for the creation of buffalo based yarn, and in particular, yarn that is made solely with buffalo hair. In the present invention, a pure buffalo yarn is produced that does not include wool or other fiber fillers.

More particularly, the present invention is a method of producing yarn solely from buffalo hair including the steps of, scouring a buffalo fleece with detergent and water at a temperature of at least 80 degrees centigrade to clean the fleece and separating the coarse from the down hair of the buffalo fleece. Next, the buffalo fleece is dehaired to remove unwanted course hair from the fleece to produce dehaired fleece, followed by blending the dehaired fleece with an oil and water emulsion in a mixing picker to produce a mixed fiber.

A modified carding step follows the blending step in which the mixed fibers produce a roving of straight and parallel fibers. In the modified carding step it has been found that passing the blended hair at between about 30 to 70 percent of the normal weight before the second carding step enhances the yarn. Carding at 40 to 60 percent or even at 50 percent weight percent has been found to be particularly useful to improve the smoothness and wear-ability of the yarn in garments.

Following the modified carding step, it has been further found that spinning both roving ends together also improves the features of the yarn. Finally, less twist and lower draft are applied to the double roving to create a softer and stronger yarn. The method of the present invention may also include the collection of the fleece from a buffalo hide using sheep shears prior to the step of scouring the fleece.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1:
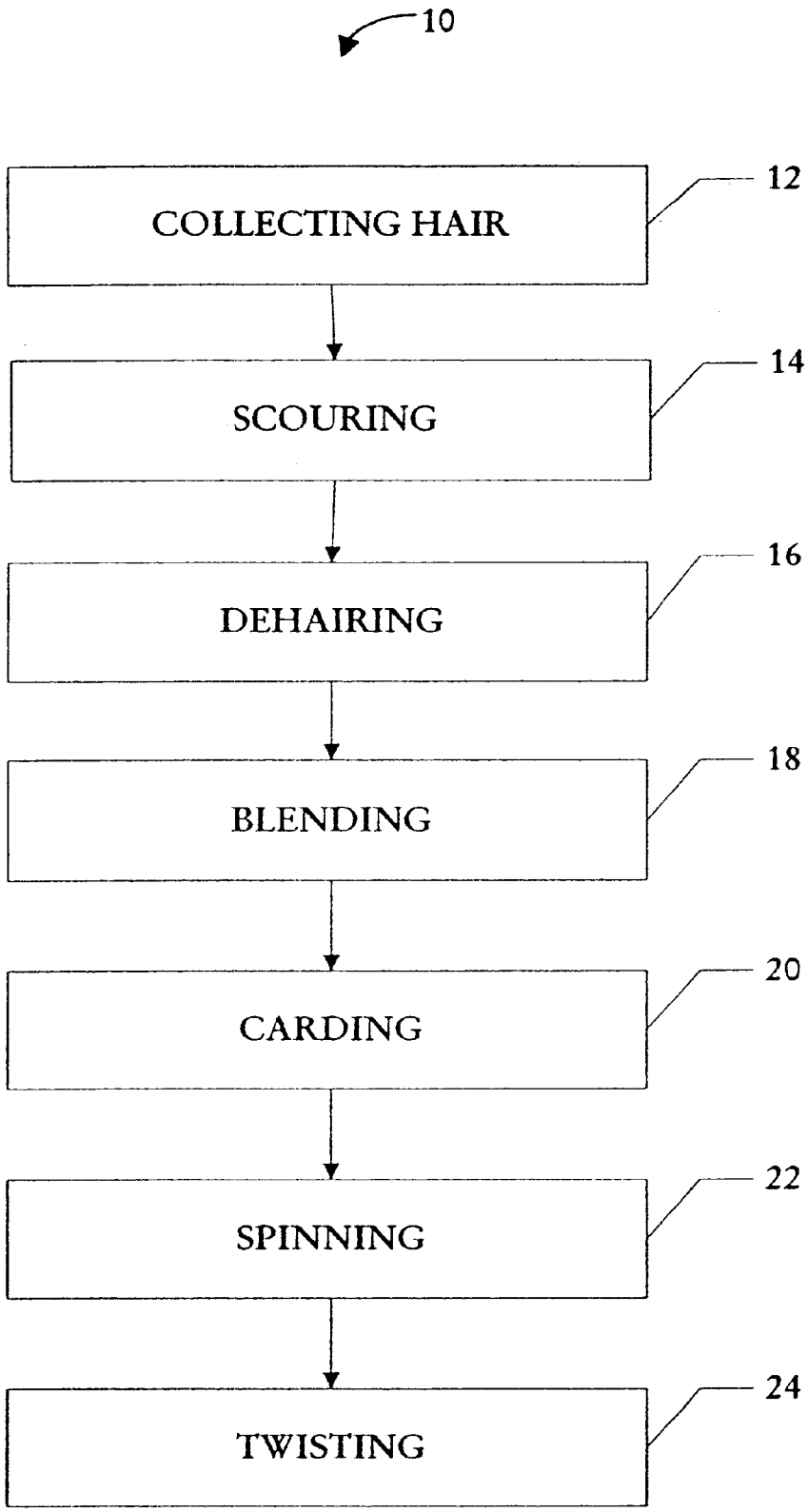
FIG. 1 is a flow diagram of a process for the creation of buffalo yarn and the processing of buffalo hair of the present invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

It is well known by the skilled in the art that in a spinning process of woolen type yarns, after the carding operation through two or more sets, a number of bands are split from the sheet or web of fibers by a "condenser", which pass the bonds on leather tapes to a series of double leather endless belts or "rubbers", and the reciprocating movement of these, rubs and compresses the fibers of each band into narrow, round untwisted slivers or slubbings (i.e., having a false or "mock" torsion) that are wound on to elongated spools to be generally mounted as coaxial spool pairs on a spinning frame, being ready to feed a section of same for the final spinning.

One such method of using and improving upon the Woolen system for use with the creation of wool-based yarn is disclosed in U.S. Pat. No. 3,979,893, issued to Gelli, et al. These inventors disclose a mechanical system and method for continuous working woolen type yarn from cards to spinning frame in which a working web of woolen type yarns leaving a finisher card is produced with reduced steps. More particularly, they take advantage of a condenser head that splits the web into parallel bands. The bands are delivered to pairs of rubbing rolls, which reciprocate relative to one another to convert the bands to slubbings having false torsion. The slubbings are conveyed to spinning frames. In most cases such slubbings are arranged as four coaxial and side-by-side elongated spools, and the "mock" torsion thereof is provided by the rubbing and compressing action of said double leather endless belts during the reciprocating movement of same. The relevant portions of U.S. Pat. No. 3,979,893 are incorporated herein as reference to teach the basic woolen system as would be known to those of skill in the art of wool-based yarns spun according to the woolen system and modifications thereof.

As an example of the Woolen system when the winding phase of slubbings on to elongated spools through the condenser is completed, these elongated spools are collected and carried to the spinning frames to continue the spinning process as final spinning of the woolen yarn as desired. Some of the problems often encountered with using the woolen system is that following a period of spinning forced interruptions occur in the process that include: (a) forming elongated spool of woolen slubbing through the condensers of prior art, which are provided with mechanical means for said purposes; (b) unloading said elongated spools and collecting same waiting for the next use on a spinning frame; and (c) carrying said elongated spools both for collection and loading of same on the spinning frames. The interruption results in a loss of time, which is by-itself not indifferent, but also a consequently higher manufacturing cost.

More particularly, the present invention is used to produce a pure buffalo down hair yarn and even a buffalo hair that includes both down and coarse hair. The method and yarn produced using the present invention begins with obtaining shaved buffalo or bison hair. Two types of yarn may be produced: a down yarn or a whole-hair yarn. The down yarn has had at least about 90 percent of the coarse hair taken out prior to processing and spinning, and preferably at least 95 percent. The whole-hair yarn, on the other hand, is yarn that has not had the coarse hair removed. Alternatively, whole hair yarn may have 50 percent buffalo down and 50 percent coarse hair. In some cases, about 10 percent wool may be added to strengthen the whole-hair yarn. The down hair grows underneath the coarse hair of the bison to keep it warm. The whole-hair yarn has been processed the same way that the down hair has except that it has not been dehaired.

In operation, the general steps of the present invention are described in conjunction with FIG. 1 in a flow chart generally designated as 10. The first step involves the collection of the buffalo or bison hair at step 12. Next, in step 14, the collected hair or fleece is scoured to remove dirt and unwanted hair contaminants. To form a more homogeneous mixture of fine soft fibers the whole hair may be dehaired in step 16 by opening the fibers. Next, in step 18 the separated hair, now generally a down hair, is emulsified with oil, water and even if necessary an anti-static compound.

In the present invention, at step 20, the hair fibers are carded at 30 to 70 the normal weight, or as used herein the "weight percent" relative to a normal roving operation. In one example, the hair is carded at one-half the normal weight to produce a mat of straightened fibers to produce a superior roving of buffalo hair. At step 22, the roving is spun into a primary buffalo yarn, however, it has been found that by spinning both roving ends together on the spinning frame to produce a double roving. Finally, at step 24, the primary buffalo yarn is twisted with less twist and low draft to the double roving to produce a yarn that is stronger, less dense and generally softer to the touch thereby providing a fabulous soft, silky feeling. Each of the steps in FIG. 1 is described in greater detail hereinbelow.

Collecting the Bison Hair

The bison hair is shaved from the torso of the bison the day it is slaughtered for meat. The hair is shaved before the hides are salted down. The bison hair may be shaved using, e.g., sheep shears. Generally, the buffalo hair is only shaved during the winter months. The raw bison fleece may be stored in 300 pound burlap bags in unheated barns that stay at about 15 degrees Fahrenheit until it is transported to the scouring plant where it is cleaned.

Scouring

Dirt and grease are removed from the raw Buffalo fleece. After the dirt and grease are removed the fleece is passed through a series of washing tanks filled with hot water and soap or detergent. It may then be rinsed and dried prior to further processing or stored.

Dehairing

The cleaned fleece is fed into a dehairing machine. The dehairing process removes the unwanted coarse hair leaving at least about 90 percent fine soft fibers, and preferably, about 95 percent fine soft fibers. The cleaned fleece is fed to the dehairing machine which moves it once slowly through eight large heads in the machine taking out about 95 percent of the unwanted coarse hair. The coarse hair cannot be completely removed because it breaks the fibers down to run them through the machine again. The dehairing process creates a very fine soft fiber.

Blending

First, the dehaired Buffalo fiber is fed into a mixing picker, which opens the fiber. Secondly, the opened fiber now receives a fine spray of emulation consisting of water oil and an anti static compound. The anti-static compound may be added before, during or after the oil and water emulsion and will generally be non-foaming. An anti-foam may also be added with the emulsion. Finally, the emulsified fiber is now blown into a large mixing chamber to thoroughly mix the fiber and the emulation. This process may be repeated several times to achieve a homogeneous mixture of both fiber and emulation.

Carding

The mixed fiber is now placed in a feeding machine that delivers an even amount of blended Buffalo fiber to a feed apron. The feed apron delivers the fiber to the carding machine. The carding machine is made up of a large number of rolls covered with the fine pointed wire, similar to a hairbrush. These rolls are of different sizes and run at different speeds. The fiber passes from one roll to another moving through the machine. As the fiber makes its way through the machine the fibers are being straightened and paralleled. It has been found that by feeding the mixed fibers at between about 30 to 70 percent the normal weight a softer, stronger product may be achieved.

This mat of straightened fiber leaves machine in a web form and is delivered to a set of dividing rolls. These rolls divide the web into ½" sections and deliver them to a condensing unit that rubs them into a cylindrical form looking like a long spaghetti. This is now called buffalo roving and many ends are wound onto a large spool. In the present invention, both roving ends may be spun as one on the spinning frame.

Spinning

The buffalo roving, now in the form of a spool or spooled fibers, is placed on the spinning machine that unwinds the roving from the spool. The roving passes through two sets of rolls running at different speeds. These are called drafting rolls. As the roving passes through these rolls it is reduced in size. The drafted roving is now wound onto a bobbin turning at very high speeds. This applies twist to the drafted roving locking the fiber together and giving it strength. It is now called buffalo yarn.

Twisting

As a result of spinning both ends in a single roving less twist may be applied to the yarn. Two ends of yarn are fed through a set of feed rolls onto a bobbin spinning at a high rate of speed. As the yarn is wound to the bobbin twist is applied to the two ends of yarn. This twist is applied in opposite direction of the single spun yarn. By removing twist from the single spun end and applying it to the two-ply ends the yarn becomes softer and bulkier. Less twist and low draft are applied to the double roving creating a softer hand and stronger yarn.

The present invention is based on the realization that prior attempts to spin buffalo yarn had failed to produce a yarn of sufficient strength and consistency. To avoid the problems associated with the production of pure buffalo yarn, prior users of buffalo based fleece have had to resort to the addition of wool fibers to provide scaffolding for the formation of a yarn that included buffalo. A key step to overcoming the problem of spinning pure buffalo yarn was the realization that the components of the buffalo hair had to be separated prior to the spinning operation. The un-separated hair could not be consistently matted in the carding process to form a consistent yarn. Therefore, the present inventor separated the coarse buffalo hair from the down buffalo hair prior to entering the basic woolen yarn procedure.

Figure 2:
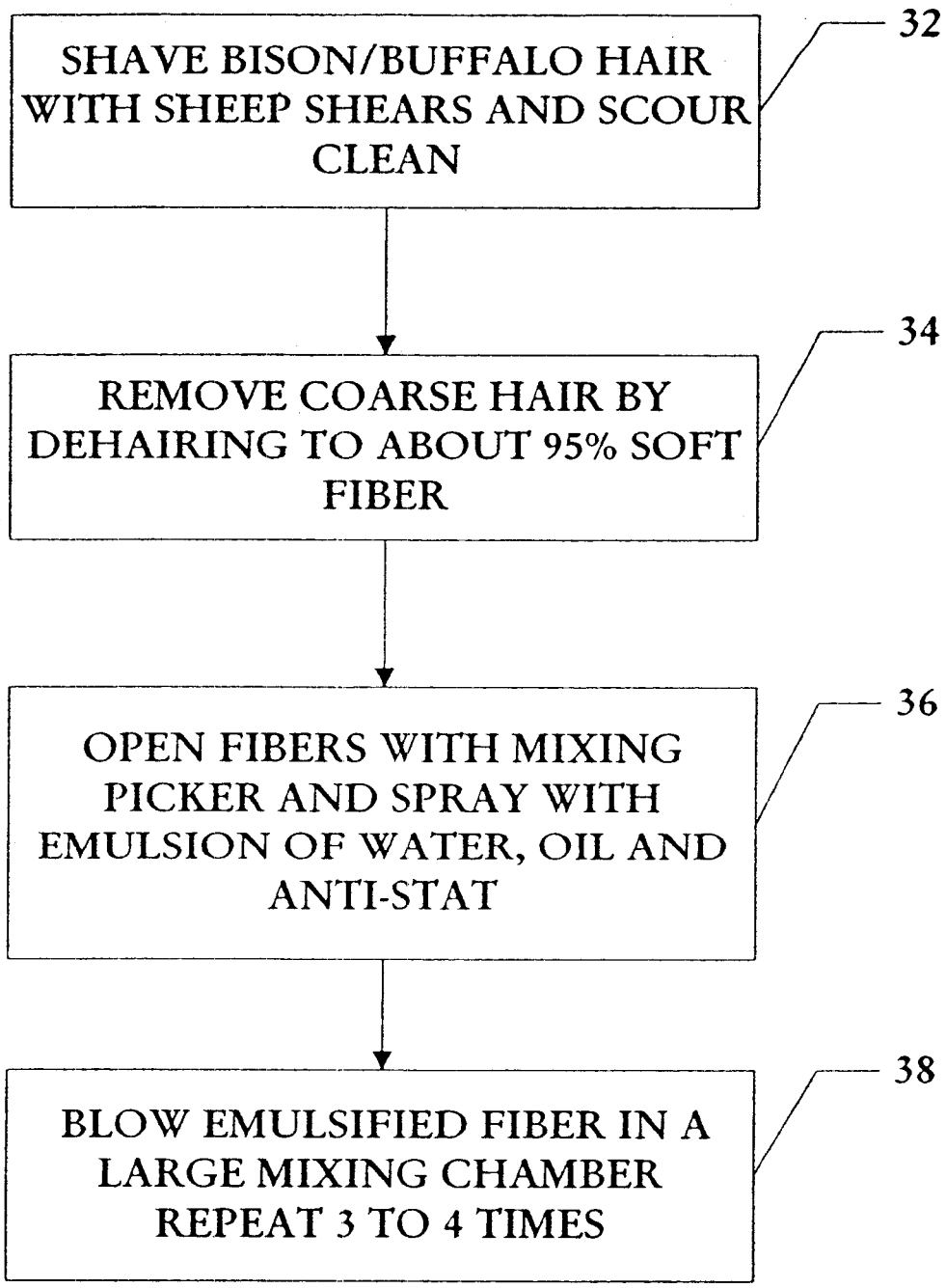
FIG. 2 is a flow diagram of the separation step of the present invention that allows for the production of pure buffalo yarn using the steps of the woolen system.

The details of the separation procedure are described in the flowchart of FIG. 2. In step 32, the buffalo or bison hair is removed from the hide with shears, preferably sheep shears or other like shears as will be known to those of skill in the art of shearing to produce a dual fiber fleece. After scouring and/or washing the fleece the coarse hair is removed or separated from the down by dehairing. The present inventor realized that the coarse and the down hair had to be separated prior to the yarn making procedure in order to make down yarn from buffalo hair. Once the down and coarse hair are separated, as indicated in step 34, about 95% of the down fiber is coarse hair free, with the remaining coarse hair being too small to further separate. When making whole hair yarn, on the other hand, both the course hair and the down are not separated, however, the inventor has found that this yarn requires the addition of extra down.

In step 36, the fibers are once again mixed in a mixing picker and sprayed with an emulsion or water and oil, as is generally done in the standard Woolen procedure. The oil and water mixture may also include other additives such as anti-static and other additives. Finally, in step 38, the fibers are once again joined by mixing in a large mixing chamber, which is then followed by the remaining steps of the woolen yarn making procedure.

While this invention has been described in reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method of producing yarn solely from buffalo hair comprising the steps of:

scouring a buffalo fleece with detergent and water sufficiently hot to clean the fleece;

separating a coarse hair from a down hair of the buffalo fleece;

blending the down with an oil and water emulsion in a mixing picker to produce a mixed fiber;

carding the mixed fiber at between about 30 to 70 percent weight to produce a roving of straight and parallel fibers;

spinning the roving to produce a yarn; and twisting the yarn to increase the bulk and softness of the yarn.

2. The method of claim 1, further comprising the step of collecting fleece from a buffalo hide using shears prior to the step of scouring the fleece.

3. The method of claim 1 wherein the mixed fiber is carded at between about 40 and 60 weight percent to produce a roving of straight and parallel fibers.

4. The method of claim 1 wherein the mixed fiber is carded at about 50 weight percent to produce a roving of straight and parallel fibers.

5. The method of claim 4 wherein the fleece is dehaired to provide buffalo down substantially free of coarse hair.

6. The method of claim 1 wherein the emulsion further comprises an anti-static compound.

7. The method of claim 6 wherein the anti-static compound is added at the same time as the oil and water emulsion.

8. The method of claim 1 wherein the yarn comprises both coarse and down hair.

9. The method of claim 1 further comprising the step of drying the fleece prior to dehairing.

10. The method of claim 1 wherein the step of blending the dehaired fine soft fibers is further defined as comprising opening the fiber prior to adding the oil and water emulsion.

11. A buffalo yarn produced by the method of claim 1.

12. A method of producing yarn solely from buffalo hair comprising the steps of:

scouring a buffalo fleece with detergent and water at a temperature of at least 80 degrees centigrade to clean the fleece;

separating a coarse hair from a down hair of the buffalo fleece;

dehairing the buffalo fleece to remove unwanted coarse hair from the fleece to produce a dehaired down;

blending the dehaired down with an oil and water emulsion in a mixing picker to produce a mixed fiber;

carding the mixed fiber at between about 30 to 70 percent weight to produce a roving of straight and parallel fibers;

spinning both ends of the roving to produce a yarn; and twisting the yarn to increase the bulk and softness of the yarn.

13. The method of claim 12 wherein the mixed fiber is carded at between about 40 and 60 weight percent to produce a roving of straight and parallel fibers.

14. The method of claim 12 wherein the mixed fiber is carded at about 50 weight percent to produce a roving of straight and parallel fibers.

15. The method of claim 12 further comprising the step of collecting fleece from a buffalo hide using sheep shears prior to the step of scouring the fleece.

16. The method of claim 12 wherein the emulsion further comprises an anti-static compound.

17. The method of claim 12 wherein the step of blending the dehaired fine soft fibers is further defined as comprising opening the fiber prior to adding the oil and water emulsion.

18. A buffalo yarn produced by the method of claim 12.

19. A method of producing yarn solely from buffalo hair comprising the steps of:

collecting fleece from a buffalo hide using sheep shears prior to the step of scouring the fleece;

scouring a buffalo fleece with detergent and water at a temperature of at least 80 degrees centigrade to clean the fleece;

separating a coarse hair from a down hair of the buffalo fleece;

dehairing the buffalo fleece to remove unwanted coarse hair from the fleece to produce a dehaired down;

blending the dehaired down with an oil and water emulsion in a mixing picker to produce a mixed fiber;

carding the mixed fiber at between about 30 to 70 percent weight to produce a roving of straight and parallel fibers;

spinning both ends of the roving to produce a yarn; and twisting the yarn to increase the bulk and softness of the yarn.

* * * * *